US010104910B2

(12) United States Patent
Holford

(10) Patent No.: US 10,104,910 B2
(45) Date of Patent: Oct. 23, 2018

(54) PACKAGE FOR SMOKING ARTICLES

(75) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 238 days.

(21) Appl. No.: 14/003,145

(22) PCT Filed: Feb. 22, 2012

(86) PCT No.: PCT/GB2012/050400
§ 371 (c)(1),
(2), (4) Date: Oct. 4, 2013

(87) PCT Pub. No.: WO2012/120273
PCT Pub. Date: Sep. 13, 2012

(65) Prior Publication Data

US 2014/0021078 A1 Jan. 23, 2014

(30) Foreign Application Priority Data

Mar. 4, 2011 (GB) ..... 1103721.5
Feb. 16, 2012 (GB) ..... 1202667.0

(51) Int. Cl.
*B65D 85/10* (2006.01)
*A24F 15/12* (2006.01)
(Continued)

(52) U.S. Cl.
CPC ..... *A24F 15/12* (2013.01); *B65D 5/4291* (2013.01); *B65D 5/662* (2013.01); *B65D 5/6691* (2013.01); *B65D 85/1045* (2013.01)

(58) Field of Classification Search
CPC ..... B65D 5/662; B65D 5/6691; B65D 85/10; B65D 85/1045; B65D 5/66
(Continued)

(56) References Cited

U.S. PATENT DOCUMENTS 2,789,752 A 4/1957 Theodore
2,956,722 A 10/1960 Prussack
(Continued)

FOREIGN PATENT DOCUMENTS

DE 2334190 A1 1/1975
DE 19858781 A1 12/1999
(Continued)

OTHER PUBLICATIONS

Office Action, dated Oct. 7, 2014, for JP Application No. 2013-555931.
(Continued)

*Primary Examiner* — Anthony Stashick
*Assistant Examiner* — Kaushikkumar Desai
(74) *Attorney, Agent, or Firm* — Cantor Colburn LLP

(57) ABSTRACT

The present invention relates to a package for smoking articles comprising a container portion (2) and a lid (3) hingedly connected to the container portion (2) about a hinge line (5). The container portion (2) has an inner frame (19) and an outer frame (18). The lid (3) includes an end portion (15) and a lid wall (12) extending from the end portion (15) that overlaps a container wall (6) of the container portion (2) when closed, the container wall (6) having a locking element (27) that locates over a corresponding locking part (35) on the lid wall (12) and a recess (24) formed in the inner frame (19) extending from an upper edge (20) of the inner frame (19). In one embodiment, a lower edge (25) of the recess (24) is spaced further from the upper edge (20) of the container wall (6) than the locking element (27). In another embodiment, the recess (24) extends into the second container wall (8).

3 Claims, 12 Drawing Sheets

(51) Int. Cl.
*B65D 5/42* (2006.01)
*B65D 5/66* (2006.01)

(58) Field of Classification Search
USPC ..... 206/265, 268, 271, 273, 275
See application file for complete search history.

(56) References Cited

U.S. PATENT DOCUMENTS

| | | | | |
|---|---|---|---|---|
| 5,097,948 | A * | 3/1992 | Campbell | 206/268 |
| 5,314,114 | A | 5/1994 | Stone | |
| 5,806,671 | A | 9/1998 | Focke et al. | |
| 6,719,131 | B1 * | 4/2004 | Focke et al. | 206/268 |
| 7,845,490 | B2 * | 12/2010 | Moore et al. | 206/268 |
| 7,934,359 | B2 * | 5/2011 | Ghini et al. | 53/461 |
| 2003/0047470 | A1 | 3/2003 | Parker | |
| 2006/0249564 | A1 | 11/2006 | Dhanda | |
| 2006/0278542 | A1 | 12/2006 | Pham et al. | |
| 2007/0108263 | A1 | 5/2007 | Nash | |
| 2008/0230410 | A1 | 9/2008 | Steven Jones et al. | |
| 2010/0320101 | A1 * | 12/2010 | Biondi et al. | 206/268 |
| 2011/0100846 | A1 * | 5/2011 | Collins | 206/268 |

FOREIGN PATENT DOCUMENTS

| | | | |
|---|---|---|---|
| EP | 1712470 | A1 | 10/2006 |
| EP | 1781554 | A1 | 5/2007 |
| EP | 2016008 | A2 | 1/2009 |
| EP | 2064134 | A1 | 6/2009 |
| EP | 2094586 | A2 | 9/2009 |
| GB | 1431173 | | 4/1976 |
| GB | 2038765 | A | 7/1980 |
| JP | 11-049151 | A | 2/1999 |
| JP | 2000-125835 | A | 5/2000 |
| JP | 3037958 | B2 | 5/2000 |
| JP | 2001524429 | A | 12/2001 |
| JP | 2003-507268 | A | 2/2003 |
| WO | 9822367 | A1 | 5/1998 |
| WO | 2006021581 | A1 | 3/2006 |
| WO | 2007128435 | A2 | 11/2007 |
| WO | 2007128435 | A3 | 11/2007 |
| WO | 2008031493 | A1 | 3/2008 |
| WO | 2008053320 | A3 | 5/2008 |
| WO | 2009095211 | A1 | 8/2009 |
| WO | 2009157344 | A1 | 12/2009 |

OTHER PUBLICATIONS

Search Report, dated Jul. 14, 2011, for GB Application No. GB1103721.5, filed Mar. 4, 2011.

Search Report, dated Feb. 17, 2012, for GB Application No. GB1103721.5, filed Mar. 4, 2011.

International Search Report and Written Opinion, dated Jun. 20, 2012, for PCT/GB2012/050400, filed Feb. 22, 2012.

International Preliminary Report on Patentability, dated Apr. 25, 2013, for International Application No. PCT/GB2012/050400, filed Feb. 22, 2012.

Written Opinion, dated Feb. 4, 2013, for PCT/GB2012/050400, filed Feb. 22, 2012.

* cited by examiner

PACKAGE FOR SMOKING ARTICLES

CLAIM FOR PRIORITY

This application is a National Stage Entry entitled to and hereby claims priority under 35 U.S.C. §§ 365 and 371 to corresponding PCT Application No. PCT/GB2012/050400, filed Feb. 22, 2012, which in turn claims priority to GB Application No. 1103721.5 filed Mar. 4, 2011, and which also claims priority to GB Application No. 1202667.0, filed Feb. 16, 2012. The entire contents of the aforementioned applications are herein expressly incorporated by reference.

TECHNICAL FIELD

The present invention relates to a package for smoking articles. In particular, the invention relates to a hinge-lid package for smoking articles, but is not limited thereto.

BACKGROUND

Hinge-lid packs are known to those skilled in the art and are in widespread use in the tobacco industry for holding cigarettes in a crush resistant manner. An example of a hinge-lid pack is shown in GB 1 431 173 and such a pack generally holds ten to twenty individual cigarettes in a predetermined arrangement. Hinge-lid packs are typically produced from a pair of cardboard blanks.

However, such conventional packs have a tendency not to stay properly closed after the initial opening of the pack, such that the lid is disposed in a partially open position. This problem is sometimes referred to as "yawning" or "smiling". Furthermore, if the pack is held upside down when closed, the lid may open under the weight of the smoking articles inside, and hence the smoking articles may fall out of the pack. It is therefore desirable to provide a hinge-lid pack with improved resistance to opening the lid in order to allow the pack to be closed securely.

In an attempt to overcome the above problem, it is known to provide a hinge-lid pack with a flap extending from the container portion of the pack that interlocks with a corresponding shoulder formed on an inner face of the lid. Such a pack provides a tactile indication that the lid is in a closed position. However, a disadvantage of such packs is that the walls of the lid must overlap the walls of the container, otherwise the flap will not engage with the shoulder and so will not 'lock' the lid. Therefore, it can be difficult to access and grip the smoking articles disposed in the container to remove them from the package because the container walls extend to the upper end of the smoking articles in the container.

It is also known to apply an enclosure for wrapping smoking articles formed by a barrier layer which has a closure label to close an aperture in the enclosure. Such a closure label has a tab which is grasped by a user to pull the closure label and reveal the aperture. However, it is a known problem that it is difficult for a user to grasp the tab in order to manipulate the cover.

Embodiments of the present invention seek to provide a package for smoking articles that overcomes or substantially alleviates the problems with packages referred to above.

SUMMARY

According to embodiments of the present invention, there is provided a package for smoking articles comprising a container portion and a lid hingedly connected to the container portion about a hinge line, the container portion having an inner frame and an outer frame, the lid including an end portion and a lid wall extending from the end portion that overlaps a container wall of the container portion when closed, the container wall having a locking element that locates over a corresponding locking part on the lid wall and a recess formed in the inner shell extending from an upper edge of the inner shell, wherein a lower edge of the recess is spaced further from the upper edge of the container wall than the locking element.

An advantage of the lower edge of the recess being spaced further from the upper edge of the container wall than the locking element is that smoking articles disposed in the container portion are easily accessible The container wall may be part of the outer frame.

The container wall may be part of the inner frame.

The recess may be formed in the container wall.

The container wall may be a first container wall and the inner frame may further comprise a second container wall extending from the first container wall, the recess being formed in the second container wall.

The locking element may be pivotable relative to the container wall about a fold line, the fold line extending parallel to, but spaced from, the hinge line. The locking element may be a flap extending from a face of the container wall.

The flap may extend from the upper edge of the container wall.

The flap may be formed in the container wall and may be spaced from the upper edge.

The inner shell may up stand from an upper end of the outer frame.

The lower edge of the recess may be spaced from the upper end of the outer frame.

The lid wall may be a front wall that lies in a plane extending parallel to an axis about which the lid rotates, and the container wall may be a front wall.

The container wall may be a first container wall and the container portion may further comprise a second container wall which extends from the first container wall, and the recess may extend into the second container wall.

The upper edge of the first wall may be disposed below the upper edge of the second wall.

The recess may be a first recess and the container wall may comprise a second recess, the locking element being disposed between the first and second recesses.

The locking part may be a step with an edge over which the flap locates when the lid is moved to a closed position.

One of the flap or step may have a first edge and a second edge, the first edge may be offset from the second edge such that, when the lid is moved to a closed position, said first edge locates over the flap or step before the second edge locates over the flap or step.

According to another aspect of embodiments of the invention, there is provided a package for smoking articles comprising a container portion and a lid hingedly connected to the container portion, the lid including an end portion and first and second lid walls extending from the end portion that overlap first and second container walls when closed, the first container wall having a recess formed in the first container wall that extends from an upper edge of the first container wall, wherein the recess extends into the second container wall.

The first container wall may further comprise a locking element that locates over a corresponding locking part on the first lid wall.

An advantage of the recess extending into the second container wall is that smoking articles disposed in the container portion are easily accessible A lower edge of the recess may be spaced further from the upper edge of the first container wall than the locking element.

The first lid wall may be a front wall that lies in a plane extending parallel to an axis about which the lid rotates, and the first container lid wall may be a front wall.

The container portion may have an outer frame and an inner frame, the inner frame may up stand from an upper end of the inner frame, and the recess may be formed in the inner frame.

The lower edge of the recess may be spaced from the upper end of the outer frame.

According to another aspect of embodiments of the invention, there is provided a package for smoking articles comprising a container portion, a lid hingedly connected to the container portion, and an enclosure for wrapping smoking articles having a closure label of an actual or potential access aperture in the enclosure, the lid including an end portion and a lid wall extending from the end portion that overlaps a container wall of the container portion when closed, the container wall having a locking element that locates over a corresponding locking part on the lid wall, and the closure label having a tab extending from a lower edge of the closure label that locates against the locking element when the closure label is in its closed position.

An advantage of the tab of the closure label locating against the locking element when the closure label is in its closed position is that it makes the tab easier to grasp.

The closure label may comprise an adhesive for adhesion to a corresponding section of the enclosure such that the closure label is resealable.

The locking element may be a flap.

The flap may extend from an edge of the container wall.

A recess may be formed in the container wall and the flap may extend from a lower edge of the recess.

The flap may have a free end which extends beyond a free edge of the tab when the closure label is in its closed position.

The flap may be resiliently deformable such that the tab is urged away from the container wall.

A free end of the tab may be disposed between a free end of the flap and an upper edge of the container wall when the closure label is in its closed position.

According to embodiments of the present invention, there is also provided a package containing smoking articles.

BRIEF DESCRIPTION OF THE DRAWINGS

Embodiments of the present invention will now be described, by way of example only, with reference to the accompanying drawings, in which.

DETAILED DESCRIPTION

Figure 1:
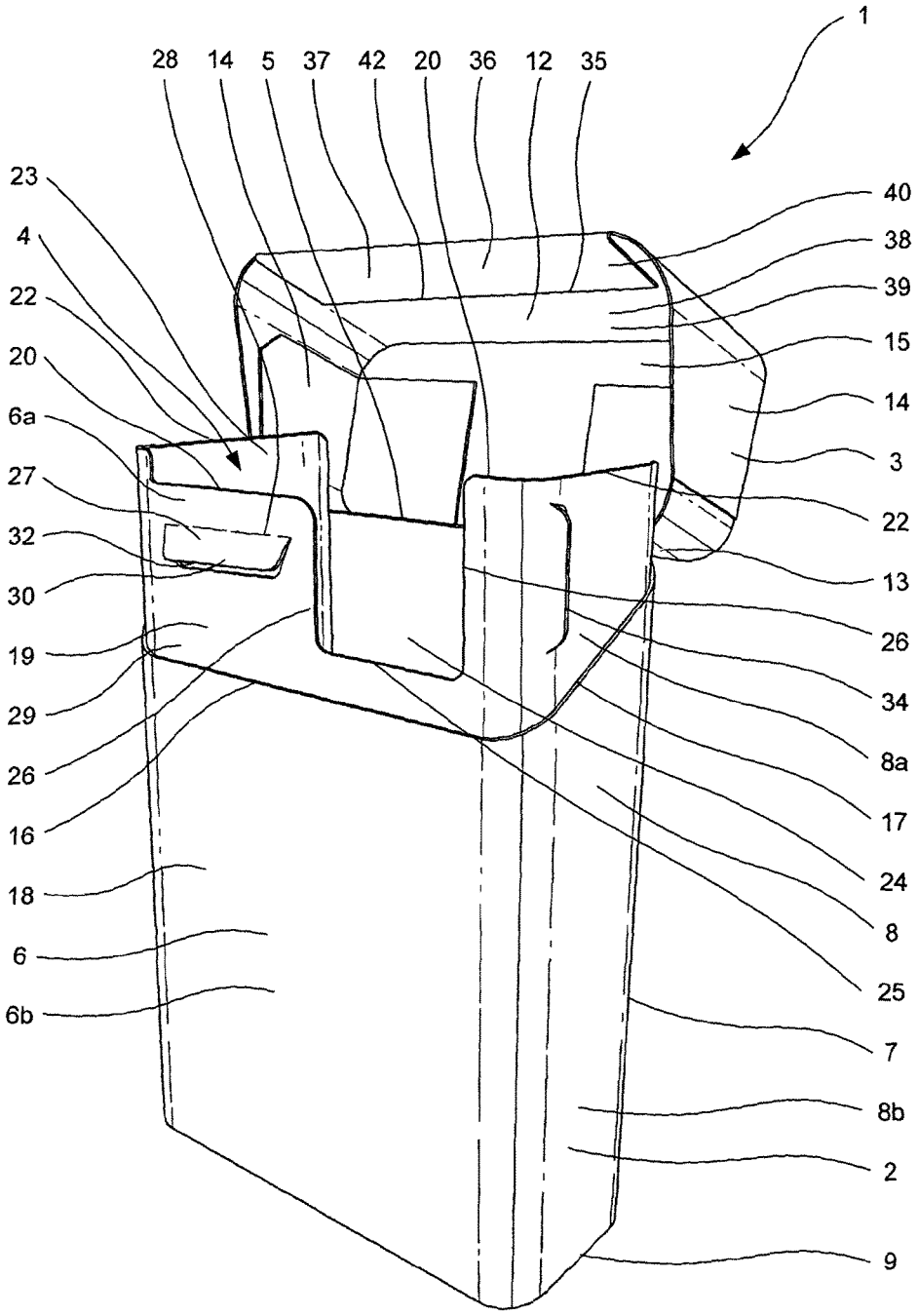
FIG. 1 is a perspective view of a package for smoking articles in accordance with an embodiment of the present invention.

Referring to the drawings, an embodiment of a package for smoking articles 1, also known as a pack, is shown in FIG. 1 comprising a container portion 2 and a lid 3.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products but is not limited thereto. The smoking article may be provided with a filter for the gaseous flow drawn by the smoker.

The container portion 2 forms a smoking article receiving space 4 in which smoking articles (not shown) are received, and the lid 3 is hinged to the container portion 2 along a hinge line 5 in order to allow the pack 1 to be opened and closed. It will be appreciated that smoking articles in the smoking article receiving space 4 are accessible when the lid 3 is in an open position (as shown in FIG. 1) and the smoking articles are retained in the smoking article receiving space 4 when the lid 3 is in a closed position.

The container portion 2 comprises container front and back walls 6, 7 which are disposed parallel to but spaced from each other, and two opposing side walls 8 disposed parallel to but spaced from each other and which extend between the container front and back walls 6, 7. A closed end 9 extends from a lower part of the container front, back and side walls 6, 7, 8, and the top of the container portion 2 is opposite the closed end 9 and is covered by the lid 3 when the lid 3 is in its closed position. The hinge line 5 about which the lid 3 is hinged to the container portion 2 is formed along a top end of the container back wall 7.

The lid 3 comprises lid front and back walls 12, 13 which are disposed parallel to but spaced from each other, and two opposing lid side walls 14 disposed parallel to but spaced from each other and which extend between the lid front and back walls 12, 13. An end portion 15 of the lid 3 extends between upper ends of the lid front, back and side walls 12, 13, 14 to close the upper end of the lid 3.

When the lid 3 is in its closed position, the lid front wall 12 overlaps and abuts against the container front wall 6, and the two opposing lid side walls 14, overlap and abut against the two opposing container side walls 8 respectively. The lid back wall 13 aligns with and is attached by the hinge line 5 to the container back wall 7 and the lid end portion 15 is opposite the container closed end 9.

The container front wall 6 includes an inner front wall **6*a* and an outer front wall 6*b*. Similarly, the two container side walls 8 include corresponding inner side walls 8***a* and outer side walls 8*b*. The inner front wall 6*a* extend from and parallel to an upper end 16 of the corresponding outer front wall 6*b* and two outer side walls 8*b*. Similarly, the two inner side walls 8*a* extend from and parallel to an upper end 17 of the corresponding outer side walls 8*b*. When the lid 2 is in its closed position, the lid front wall 12 lies substantially adjacent to and overlaps the inner front wall 6*a* of the container front wall 6, and the two lid side walls 14, lie adjacent to and overlap the corresponding inner side walls 8*a* of the container side walls 8.

Figure 2:
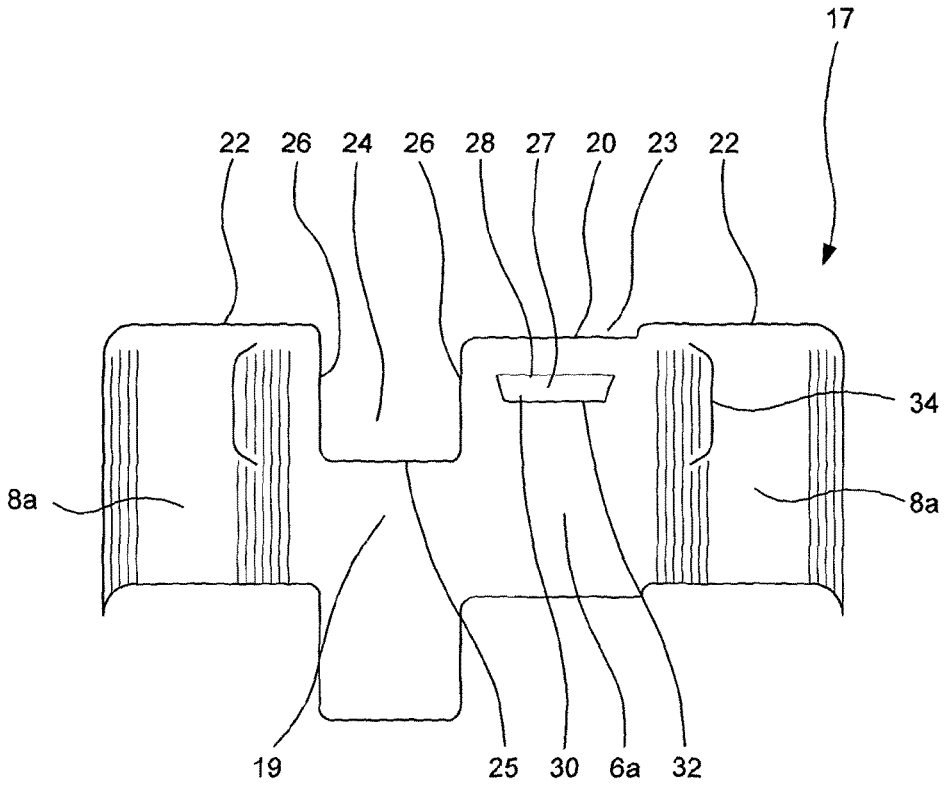
FIG. 2 is a plan view of the blank used to form the inner frame of the package for smoking articles shown in FIG. 1.

In FIG. 1, the lid 3 is shown in its open position. In the present embodiment, the pack 1 has an outer frame 18 and an inner frame 19. The outer frame 18 includes the lid 3 and part of the container 2, and the inner frame 19 forms part of the container 2. A blank of the inner frame 19 is shown in FIG. 2. In FIG. 2, the bold lines denote cut-lines and the thin lines denote fold lines. The inner frame 19 forms the inner front wall 6*a* and inner side walls 8*a* of the container front wall 6. The lid 3 therefore fits snugly over the inner frame 19 when the lid is in its closed position.

The container and lid 2, 3 are formed from a stiff, resilient material, for example a cardboard or plastic, such that the hinge-lid pack retains its shape and so that the contents of the smoking article receiving space 4 are protected.

The container front wall 6 has an upper edge 20 which is formed by the container inner front wall 6*a* and is spaced from the upper end 16 of the container outer front wall 6*b*. Similarly, the container side walls 8 have an upper edge 22 which are formed by the container inner side walls 8*a* and are spaced from the upper end 17 of the container outer front wall 8*b*. In the embodiment shown in FIG. 1 a cut-out 23 is formed in the outer front wall 6*a* so that a section of the front wall upper edge 20 is below the side wall upper edges 22.

A recess 24 is formed in the container front wall 6. The recess 24 extends in the inner front wall 6*a* of the container portion 2 from the upper edge 20 of the front wall 6. The recess 24 has a lower edge 25, and side edges 26 which extend between the upper edge 20 of the front wall 6 and the recess lower edge 25. The lower edge 25 of the recess 24 extends parallel to, but spaced from, the upper edge 20 of the front wall 6, and the side edges 26 extends transverse to the lower edge 25.

The lower edge 25 of the recess 24 is spaced from the upper end 16 of the outer front wall 6*b* so that the front wall 12 of the lid 3 overlaps the container front wall 6 along its entire width when the lid is in its closed position to ensure that there is no gap between the smoking article receiving space 4 and the outside of the pack.

A flap 27, which acts as a locking element, is formed in the inner front wall 6*a* of the container portion 2. The flap 27 is formed by a cut line formed in the inner front wall 6*a* and is foldable about a fold line 28. The flap 27 extends outwardly from a face 29 of the inner front wall 6*a* and extends downwardly. In the present embodiment the flap 27 is spaced from the upper edge 20 of the container front wall 6.

A free end 30 of the flap 27 is spaced from the fold line 28 with a free edge 32 and the flap 27 is formed from a stiff resilient material, so that it is deformable.

Therefore, the flap 27 may be resiliently deformed towards the inner front wall 6*a*. The flap 27 is disposed between the upper edge 20 of the container inner front wall 6*a* and the upper end 16 of the container outer front wall 6*b*. Furthermore, the flap 27 is formed to extend from the face 29 of the inner front wall 6*a* between the upper edge 20 of the container inner front wall 6*a* and the lower edge 25 of the recess 24. Therefore, the flap 27 is disposed closer to the upper edge of the container inner front wall 6*a* than the lower edge 25 of the recess 24. The flap 27 is also spaced from the side edge 26 of the recess 24.

The hinge-lid pack also comprises a pair of ears 34 extending outwardly sideways from the inner side walls 8*a* of the container 3. Each ear 34 extends perpendicularly from a container side walls 8 parallel to and from the inner front wall 6*a* of the container portion 2. Each ear 34 is formed by means of a cut line formed in the inner side walls 8*a*. An advantage of the recess 24 being formed in the container front wall 6 only is that ears 34 are able to be disposed to extend from the container side walls 8 to help retain the lid in a closed position.

A step 35, which acts as a locking part, is formed on an inner face 36 of the front wall 12 of the lid 3. The step 35 divides the inner face 36 of the lid front wall 12 into an upper level 37 and a lower level 38. The front wall 12 of the lid 3 is formed from outer and inner layers 39, 40, with an edge of the inner layer 40 forming an edge 42 of the step 35. The outer and inner layers 39, 40 are adhered to each other using an adhesive.

The flap 27 is configured to extend from the container front wall 6 such that it is aligned with and locates over the step 35 of the inner face 36 of the lid front wall 12 as the lid 3 is moved into its closed position. The flap 27, acting as a locking element, and the step 35, acting as a locking part, together form a locking mechanism to retain the lid 3 in its closed position.

Operation of the hinge-lid package according to the above exemplary embodiment will now be described with reference to FIGS. 1 and 2. When the hinge lid-pack 1 is assembled as described above, smoking articles (not shown) are disposed in the smoking article receiving space 4 of the pack. The lid 3 is then hingedly rotatable to open and close the container portion 2 such that the smoking articles (not shown) are accessible to a user when the lid 3 is in its open position and are retained in the pack when the lid 3 is in its closed position.

When the lid 3 is in its open position (as shown in FIG. 1), the smoking article receiving space 4 is accessible. Therefore, smoking articles may be removed from the container 3. The recess 24 forms an opening along the front of the pack which allows a user to easily grasp a smoking article and manoeuvre the smoking article from the pack without having to grasp the cigarette through the top opening of the pack. Furthermore, with the above described embodiment it is possible to position a locking element on the front wall of the pack so that the lid overlaps the locking element without reducing the length of a recess to ensure that the lid does overlap the locking element.

As the lid 3 is rotated from its open position to its closed position, the lid front and side walls 12, 14 overlap the container front and side walls 6, 8 respectively. The flap 27 initially extends at an acute angle to the face 29 of the container front wall 6. As the lid 3 is rotated into its closed position, the free edge 32 of the flap 27 is brought into contact with the inner face 36 of the lid front wall 12. The flap 27 is urged against the inner face 36 due to the resilience of the flap 27 and/or the front wall 6 of the container portion 2. The free edge 32 of the flap 27 initially contacts the upper level 37 and slides therealong as the lid 2 is closed until the free edge 32 locates over the step 35. The flap 27 is resiliently urged towards and impacts against the lower level 38 and an audible click is generated as the flap 27 is resiliently deformed towards and contacts the lower level 38. Therefore, a user is provided with an audible feedback as the lid is closed.

The lid 3 is then in its closed position. The lid 3 is retained in its closed position by the free edge 32 of the flap 27 engaging against the step 35. The flap 27 is therefore interlocked with lid, which is prevented from rotating into its open position due to the flap 27 abutting against the step 35.

A rotational force is applied to the lid 3 to move the lid 3 from its closed position to its open position so that access to the enclosed smoking article space 12 is available. As the lid 3 is urged to rotate, the step 35 acts on the flap 27 and urges it to rotate about its fold line 28. The lid front wall 12, container front wall 6 and/or the flap 27 are resiliently deformable so that the flap 27 is able to rotate and the lid 3 is able to be moved into its open position.

Figure 3:
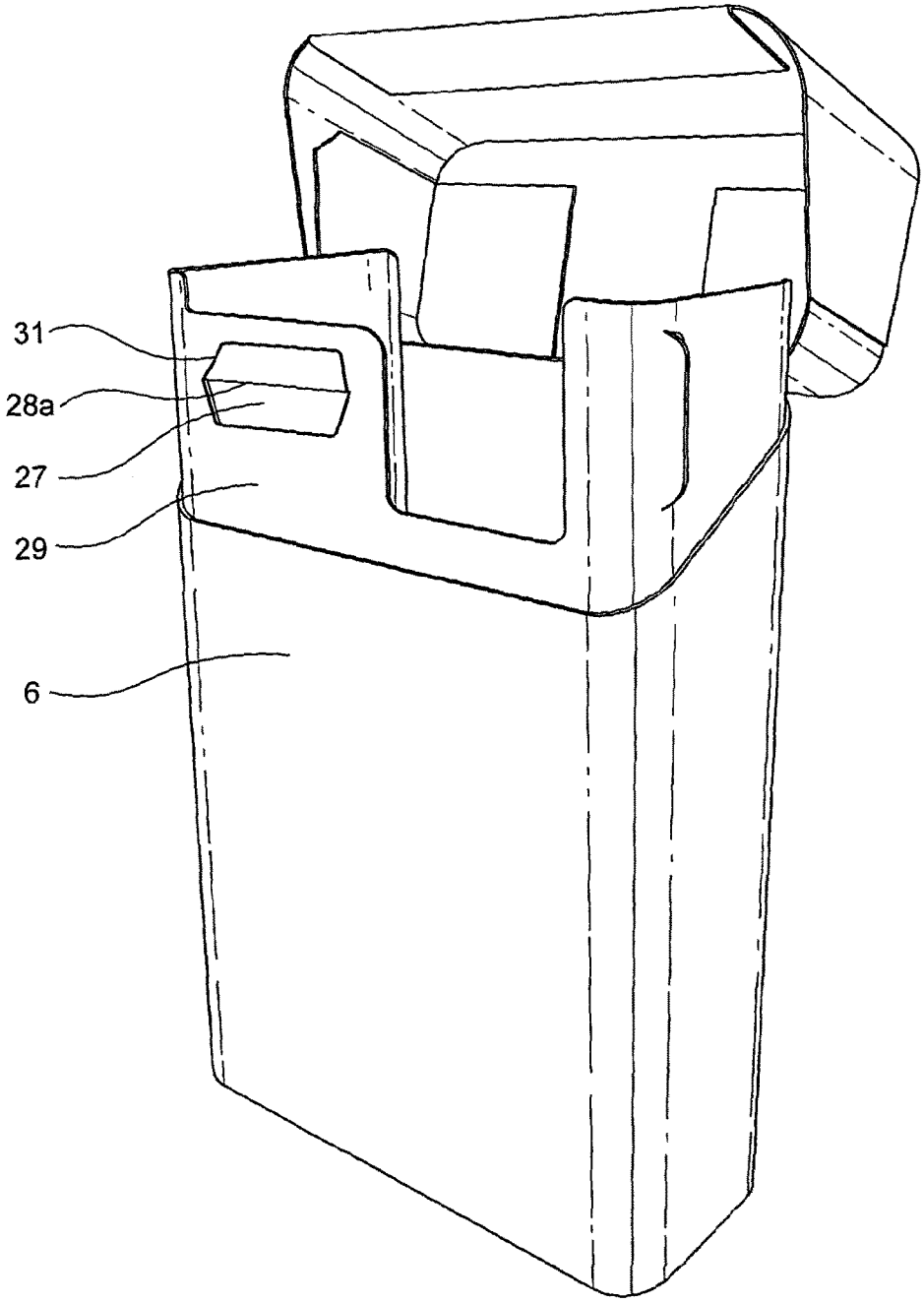
FIG. 3 is a perspective view of a package for smoking articles in accordance with another embodiment of the present invention.

In an alternative embodiment shown in FIG. 3 it is envisaged that the flap is formed in the front wall above a fold line, but is folded over to extend downwardly. This arrangement of the package for smoking articles is generally the same as the arrangement described in the above exemplary embodiment, and so a further detailed description will be omitted herein. Furthermore, components and features corresponding to components and features described in the foregoing embodiment will retain the same reference numerals.

The flap 27, which acts as a locking element, is formed in the inner front wall 6*a* of the container portion 2. The flap 27 is formed by a cut line 31 formed in the inner front wall 6*a* and is foldable about a fold line 28*a*. The flap 27 is folded back over the container front wall 6 so that it extends downwardly over the face 29 of the container front wall 6. An advantage of this arrangement is that the flap is urged outwardly away from the front wall 6 and extends at an acute angle from the face 29 of the container front wall 6. Another advantage is that the resilience of the flap ensures that the flap 27 locates over the step 35 formed in the lid front wall 12. Therefore, the haptic feedback produced, including a clicking noise, is enhanced.

Although in the above embodiments the flap 27 is formed in the inner front wall 6*a* of the container 2 and communicates with the step 35 formed in the lid front wall 12, it will be appreciated that the invention is not limited thereto.

Figure 4:
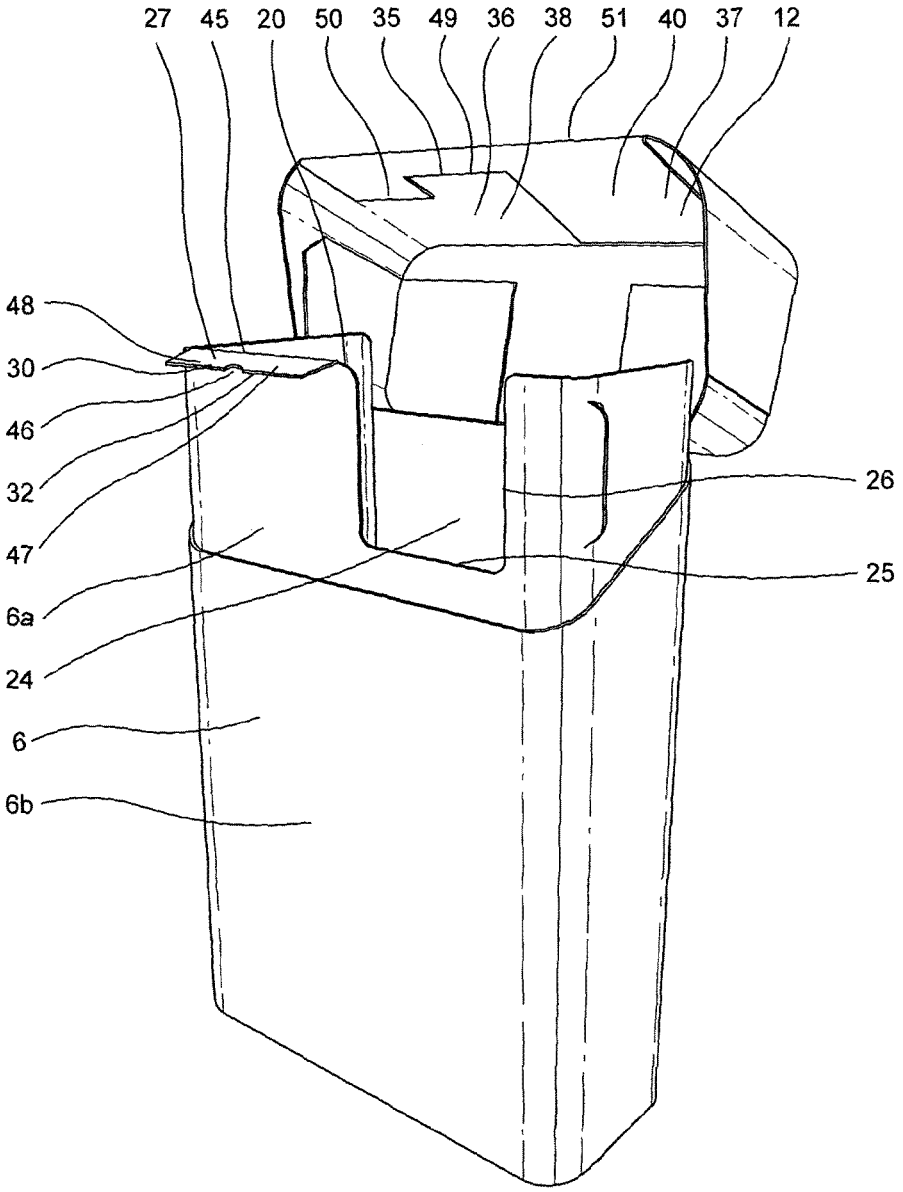
FIG. 4 is a perspective view of a package for smoking articles in accordance with another embodiment of the present invention.
Figure 5:
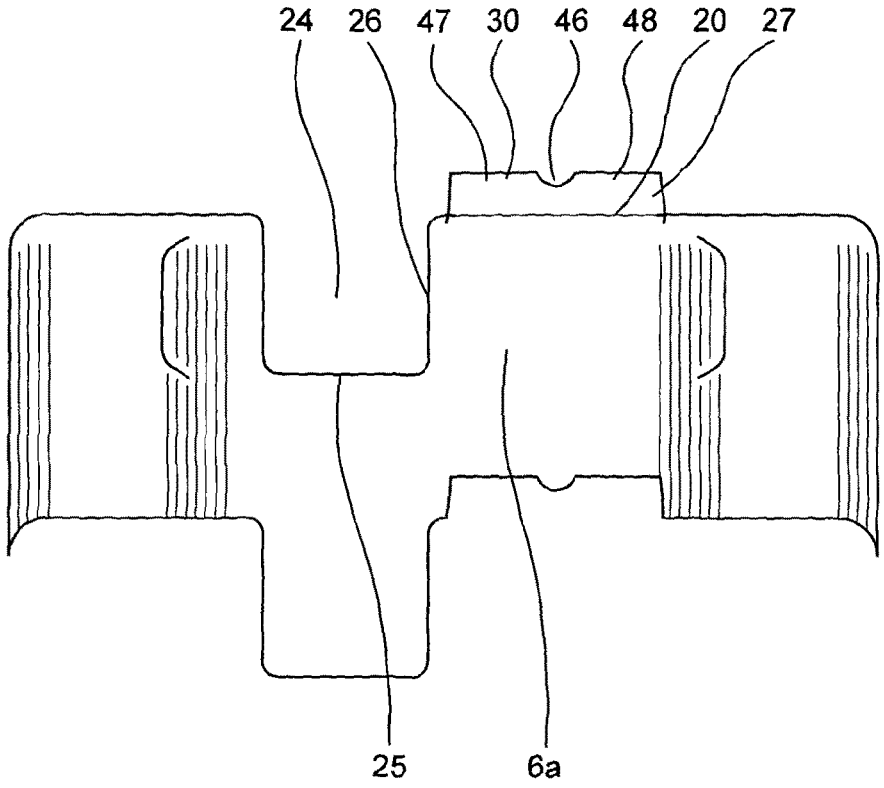
FIG. 5 is a plan view of the blank used to form the inner frame of the package for smoking articles shown in FIG. 4.

For example, another exemplary embodiment is shown in FIGS. 4 and 5. This arrangement of the package for smoking articles is generally the same as the arrangement described in the above exemplary embodiment, and so a further detailed description will be omitted herein. Furthermore, components and features corresponding to components and features described in the foregoing embodiment will retain the same reference numerals.

However, in this embodiment the flap 27 extends from the upper edge 20 of the inner front wall 6*a* of the container portion 2. The flap 27 is foldable about a fold line 45 which extends along the upper edge 20 of the container front wall 6 and is shown in FIG. 4 folded back over the container front wall 6 so that it extends downwardly over the face 29 of the container front wall 6. An indent 46 or slit is formed in the flap 27 extending from the free edge 32 of the flap 27 to divide the outer end 30 of the flap 27 into two distinct tab elements 47, 48. The flap 27 is formed from a stiff resilient material, so that it is deformable, and therefore the two tab elements are able to resiliently deform independently of each other. The fold line 45 is configured as a perforation line in order to make it easier for the flap 27 to fold over and it extends at an acute angle from the face 29 of the container front wall 6. Although the flap 27 is notched or split by an indent or slit in the present embodiment, it will be appreciated that in an alternative embodiment the flap 27 will not have an indent or slit.

Therefore, the flap 27 is disposed on the upper edge 20 of the inner front wall 6*a*, and so it is closer to the upper edge 20 than the lower edge 25 of the recess 24. Therefore, when the lid is moved into its closed position the lid front wall 12 overlaps the flap 27 and the flap 27 abuts against the lid front wall 12, and the recess 24 is formed in the front wall so that a maximum length of the recess 24 may is achieved to enable smoking articles to be easily removed from the smoking article receiving space 4.

In this exemplary embodiment the step 35 has two step edges 49,50 which are offset from each other so that one of the step edges 49 is disposed closer to the lower end 51 of the lid front wall 12 than the other edge 50. The two step edges 49,50 extend parallel but spaced from each other.

The flap 27 extends from the container front wall 6 such that it is aligned and locates against the step 35, and each of the two tab elements 47, 48 is aligned to locate over one of the respective step edges 49,50 as the lid 3 is moved into its closed position. Therefore, when the lid 3 is moved into its closed position, one of the tab elements 47 locates over the corresponding step edge 49, and is resiliently urged towards and impacts against the lower level 38 of the lid front wall 12 to generate a first audible click.

The other tab element 48 then locates over the other step edge 50 as the lid 3 is further moved into its closed position and is resiliently urged towards and impacts against the lower level 38 of the lid front wall 12 to generate a second audible click. The lid 3 is then in its closed position.

It will be appreciated that the number of audible clicks produced may be changed by providing one or more additional steps in the lid front wall 12. Moreover, it will also be appreciated that the number of audible noises produced may be changed by varying the number and length of the tab elements of the flap, together with the number and length of corresponding step edges.

Although in the above embodiments the pack 1 comprises outer and inner frames 18,19, it will be appreciated that the invention is not limited thereto and that the pack may be formed from multiple frames of various arrangements.

Figure 6:
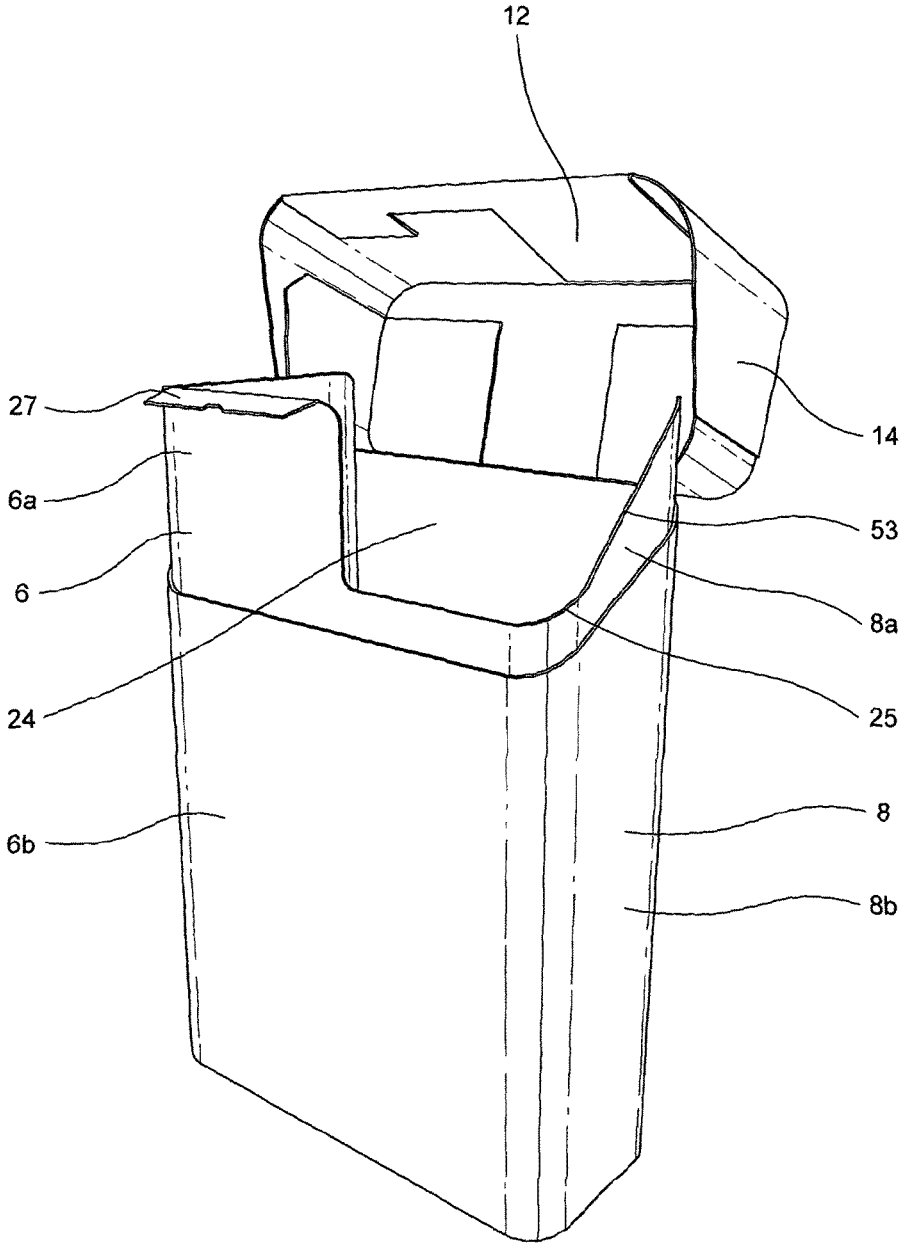
FIG. 6 is a perspective view of a package for smoking articles in accordance with another embodiment of the present invention.
Figure 7:
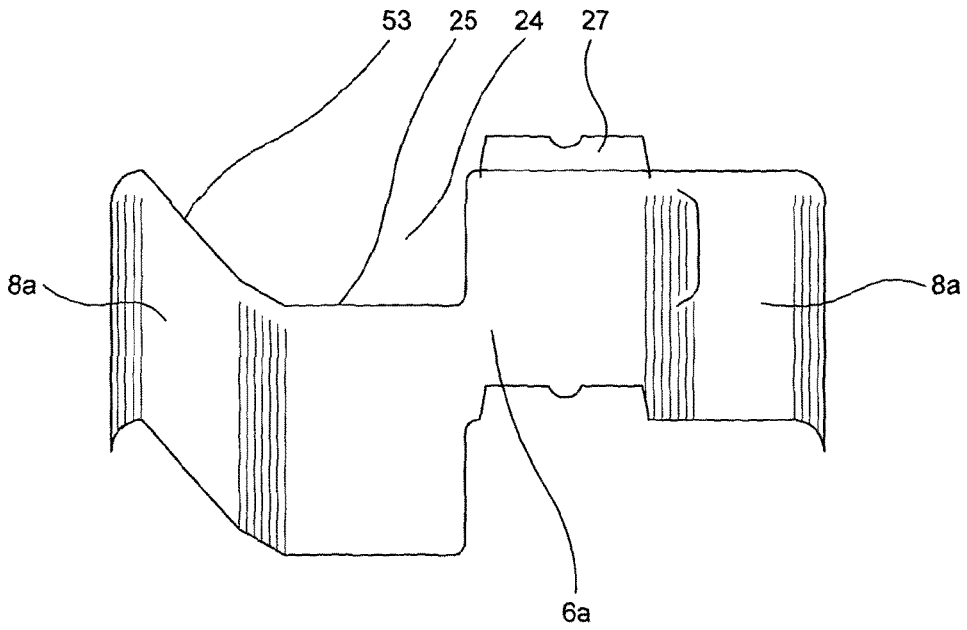
FIG. 7 is a plan view of the blank used to form the inner frame of the package for smoking articles shown in FIG. 6.

A further exemplary embodiment is shown in FIGS. 6 and 7. The arrangement of the package for smoking articles is generally the same as the arrangement described in the above exemplary embodiments, and so a further detailed description will be omitted herein. Furthermore, components and features corresponding to components and features described in the foregoing embodiments will retain the same reference numerals.

In this exemplary embodiment, the recess 24 extends into the adjacent container side wall 8, so that an upper rim 53 of the side wall 8 is formed by the lower edge 25 of the recess 24. Therefore, the recess 24 is formed in the container front wall 6 and one of the container side walls 8. This arrangement enables a user to easily remove a smoking article from the smoking article receiving space 4 when the lid 3 is in its open position. In particular, the above arrangement aids the removal of a first cigarette from a tightly packed bundle. The removal of a first cigarette from a tightly packed bundle is difficult, however by providing access to two sides of a cigarette by extending a recess into two walls of the container a user is able to more easily grasp a cigarette and provide a removal force.

The upper rim 53 of the side wall 8 in which the recess 24 is defined is formed by the inner side wall 8*a*, and the upper rim 53 is spaced from the upper end 17 of the outer side wall

8*b* so that the lid side wall 14 overlaps a portion of the container side wall 8 along its length so that no gap is formed between the smoking article receiving space 4 and outside the pack. Although in the above embodiment a locking flap 27 is provided, it will be understood that the flap may be omitted or another locking means provided. Furthermore, the inner frame may be integrally formed with the outer frame.

Although in the above embodiments the pack 1 comprises outer and inner frames 18,19, it will be appreciated that the invention is not limited thereto and that the pack may be formed from multiple frames of various arrangements.

Although in the above exemplary embodiment the flap is formed to extend from the upper edge 20 of the container front wall, it will be appreciated that other arrangements are envisaged, for example, the flap being formed by a cut-line in the front wall of the container portion 2.

Although in the above exemplary embodiments one recess is formed to one side of the flap, it will be appreciated that another embodiment may have a second recess extending from the upper edge of the front wall so that the flap is disposed between the two recesses.

Figure 8:
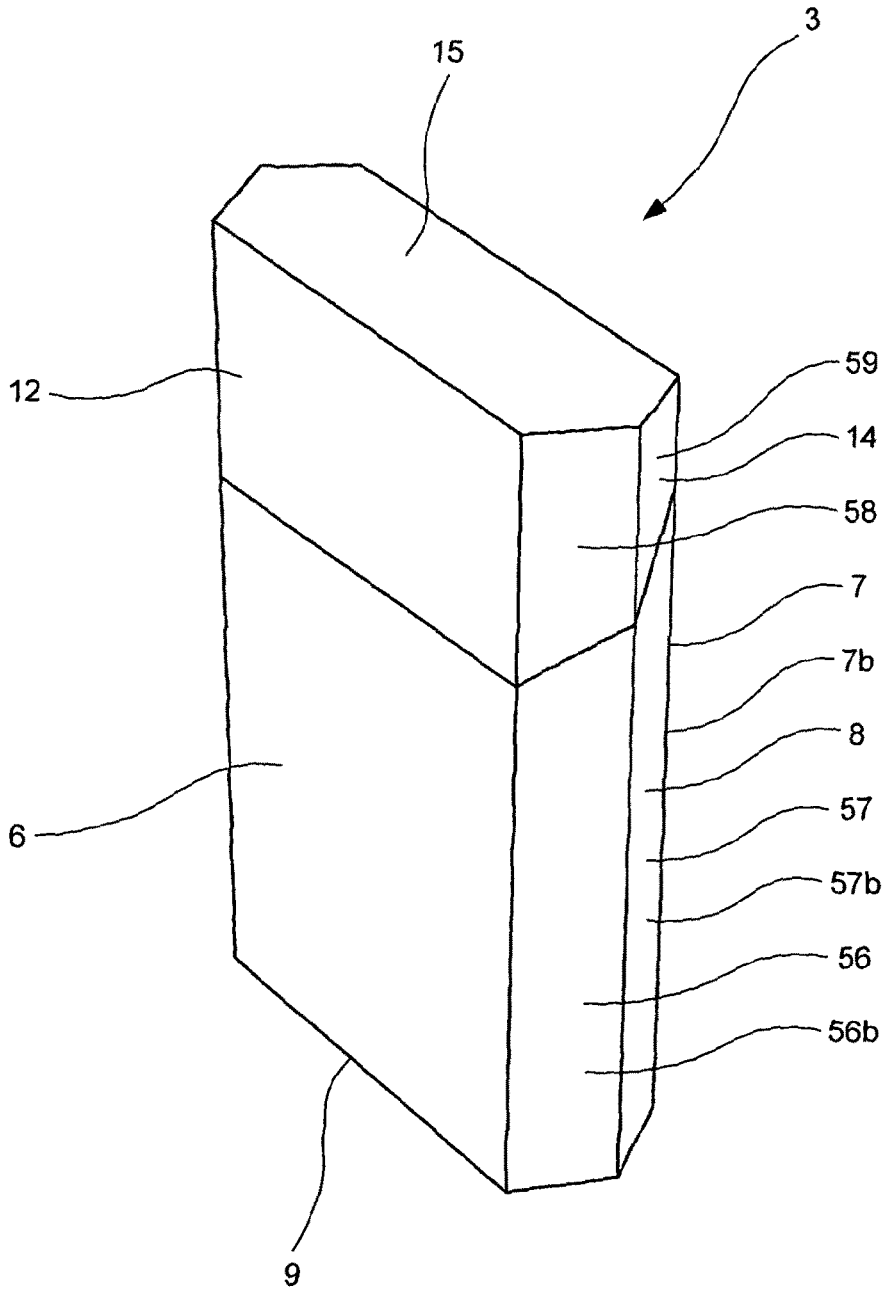
FIG. 8 is a perspective view of a package for smoking articles in accordance with a further embodiment of the present invention.
Figure 9:
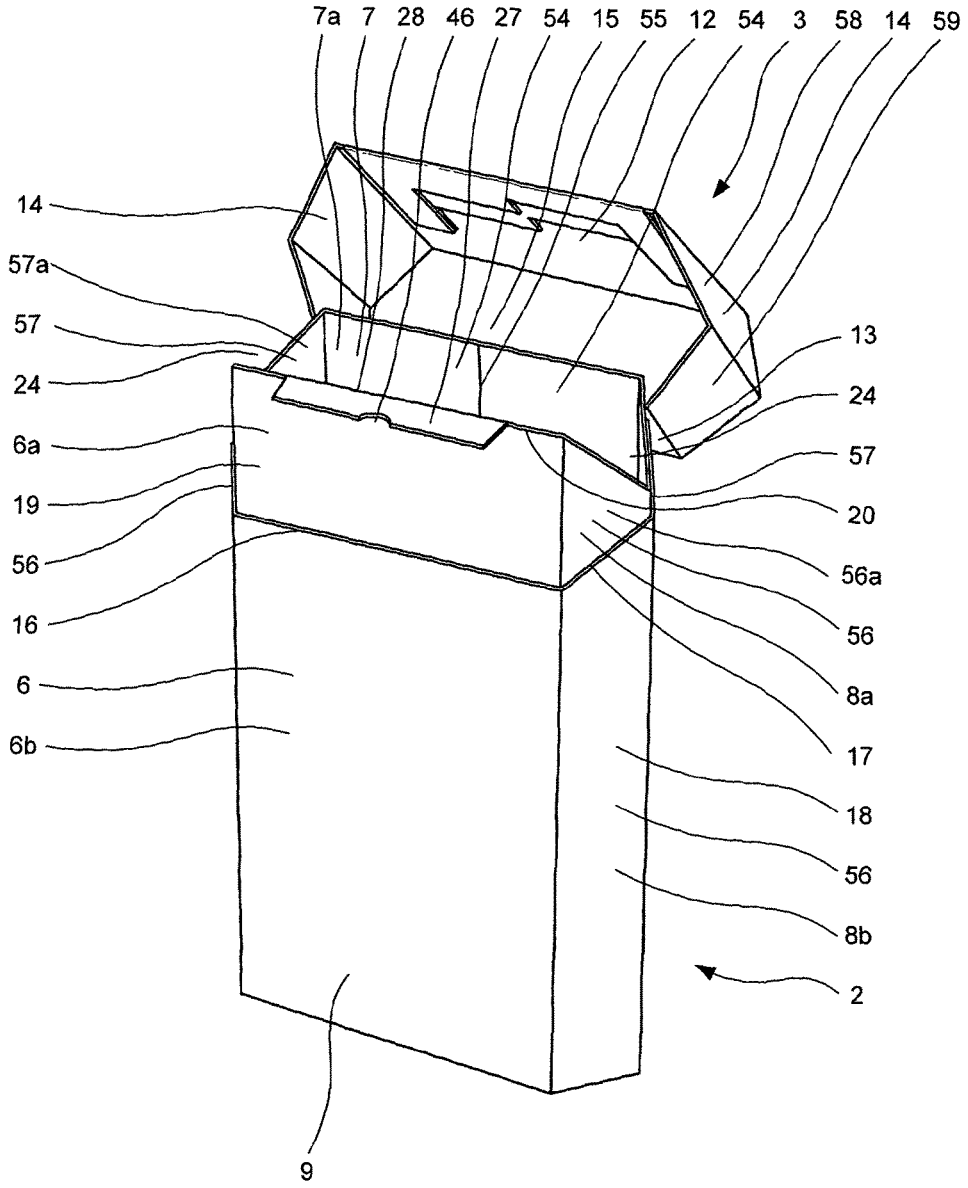
FIG. 9 is a perspective view of the package for smoking articles shown in FIG. 8 with the lid open.

An alternative form of the package is shown in FIGS. 8 and 9. Reference numerals are retained from above-described embodiments for like elements. This arrangement of the package for smoking articles is generally the same as the arrangement described in the above exemplary embodiment, and so a detailed description will be omitted herein.

The package shown in FIGS. 8 and 9 includes an outer frame 18 and an inner frame 19. The outer frame 18 includes the lid 3 and part of the container portion 2, and the inner frame 19 forms part of the container 2. The container front wall 6 includes an inner front wall 6*a* and an outer front wall 6*b*. Similarly, the two container side walls 8 include corresponding inner side walls 8*a* and outer side walls 8*b*. The inner front wall 6*a* extends from an upper end 16 of the outer front wall 6*b*. Similarly, the two inner side walls 8*a* extend from an upper end 17 of the corresponding outer side walls 8*b*. The container back wall 7 includes an inner rear wall 7*a* and an outer front wall 7*b*. The inner back wall 7*a* extends from an upper end of the outer rear wall 7*b*. A closed end 9 of the container 2 extends from a lower part of the container front, back and side walls 6, 7, 8.

When the lid 2 is in its closed position, as shown in FIG. 8, a lid front wall 12 lies substantially adjacent to and overlaps the inner front wall 6*a* of the container front wall 6, and two lid side walls 14, lie adjacent to and overlap the corresponding inner side walls 8*a* of the container side walls 8. A lid back wall 13 lies substantially adjacent to and overlaps the inner back wall 7*a* of the container back wall 7. An end portion 15 of the lid 3 extends between upper ends of the lid front, back and side walls 12, 13, 14.

The inner frame 19 is formed by the inner front wall 6*a*, the inner side walls 8*a* and the inner back wall 7*a*. The inner frame 19 extends around and from an upper end of the outer front wall 6*b*, outer side walls 8*b* and outer back wall 7*b*. The inner side walls 8*a* extends from opposing edges of the inner front wall 6*a*. The inner back wall 7*a* is formed from two back sections 54. The two back sections 54 each extend from a rear edge of the inner side walls 8*a*. Free ends 55 of the back sections extend towards each other when the inner frame 19 is disposed in the outer frame 18. The two rear sections 54 forming the inner back wall 7*a* provide support for the rear end of each of the inner side walls 8*a*. Therefore, the rigidity of the inner frame 19, in particular the inner side walls 8*a*, is increased.

Each container side wall 8 has two parts, a front part 56 and a rear part 57. The rear part 57 of each container side wall 8 extends at an angle to the front part 56 of each container side wall 8. The front and rear parts 56, 57 of each side wall 8 are separated by a fold line. The front part 56 of each side wall 8 extends between the front wall 6 of the container 2 and the corresponding rear part 57. The rear part 57 of each side wall 8 extends between the corresponding front part 56 and the back wall 7 of the container 2. Similarly, each lid side wall 14 has two parts, a front part 58 and a rear part 59. The lid rear part 59 of each lid side wall 14 extends at an angle to the lid front part 58 of each lid side wall 14. The front and rear parts 58, 59 of each side wall 14 are separated by a fold line. The lid front part 58 of each lid side wall 14 extends between the lid front wall 12 and the corresponding lid rear part 59. The lid rear part 59 of each lid side wall 14 extends between the corresponding lid front part 58 and the lid back wall 13.

The closed end 9 of the container 2 and the end portion 15 of the lid 3 are each formed to have a hexagonal shape. The inner frame 18 is formed to have inner front and rear parts 56*a*, 57*a* of the container side walls 8. The inner front and rear parts 56*a*, 57*a* extend from the upper end of corresponding outer front and rear parts 56*b*, 57*b*. When the lid 2 is in its closed position, as shown in FIG. 8, the lid front and rear parts 58, 59 lie adjacent to and overlap the corresponding inner front and rear parts 56*a*, 57*a* of the container side walls 8.

A recess 24 is formed in each of the inner container side walls 8*a*. The inner container side walls 8*a* have an upper edge 22. The recess 24 extends in the inner front and rear parts 56*a*, 57*a*. Each recess 24 extends downwardly at an angle from an upper edge 20 of the inner front wall 6*a* to an upper edge of the inner back wall 7*a*. The recesses 24 are V-shaped. However, it will be understood that in an alternative embodiment, the recesses 24 may have an alternative appearance. Furthermore, in an alternative arrangement a recess may be formed in one of the inner container side walls 8*a* only. Each recess 24 has a lower edge 25.

A flap 27 extends from an upper edge 20 of the inner front wall 6*a* of the container portion 2. Therefore, the flap 27 extends from the inner frame 19. The flap 27 is foldable about a fold line 28 which extends along the upper edge 20 of the inner front wall 6*a* and is shown in FIG. 9 folded back over the inner front wall 6*a* so that it extends downwardly over the face 29 of the inner front wall 6*a*. Although the flap 27 is notched or split by an indent 46 or slit in the present embodiment, it will be appreciated that in an alternative embodiment the flap 27 will not have an indent or slit.

One advantage of the or each recess being formed in the side wall of the container portion 2 is that the flap 27 can extend substantially along the width of the front wall 6 of the container portion 2.

The flap 27 extends above the lower edge 25 of the recess 24. Therefore, when the lid is moved into its closed position the lid front wall 12 overlaps the flap 27 and the flap 27 abuts against the lid front wall 12.

The pack is operable in generally the same manner as described in the above embodiments. Therefore, when the lid 3 is moved into its closed position, flap 27 locates over the corresponding step edges to generate a audible click until the lid 3 is in its closed position.

It will be appreciated that the number of audible clicks produced may be changed by providing a different number of steps in the lid front wall 12. Moreover, it will also be appreciated that the number of audible noises produced may be changed by varying the number and length of the tab elements of the flap, together with the number and length of corresponding step edges.

When the lid 3 is moved into its open position, a user has access to smoking articles contained therein by means of the recesses formed in the inner frame 19.

Figure 10:
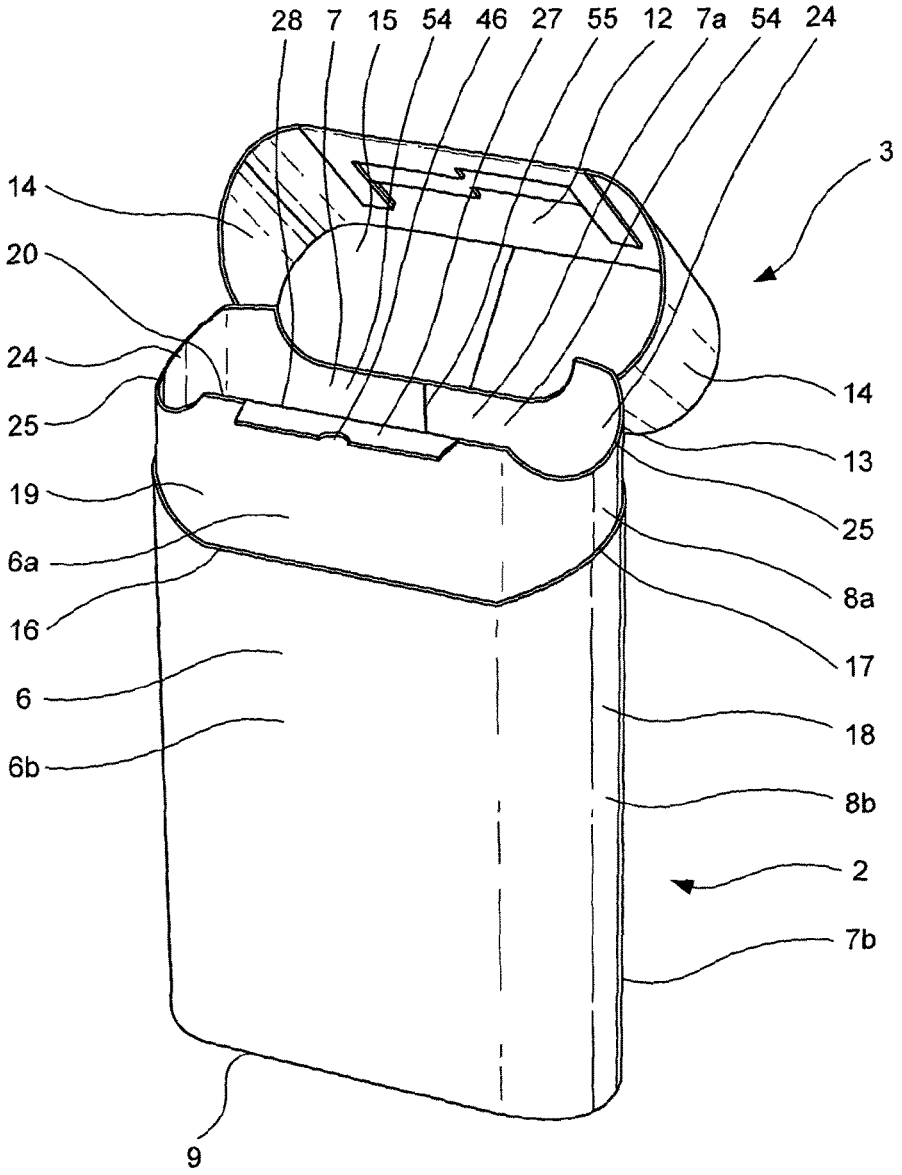
FIG. 10 is a perspective view of a package for smoking articles in accordance with another embodiment of the present invention.

An alternative form of the package is shown in FIG. 10. Reference numerals are retained from above-described embodiments for like elements. This arrangement of the package for smoking articles is generally the same as the arrangement described in the above exemplary embodiment, and so a detailed description will be omitted herein.

The package shown in FIGS. 10 has an outer frame 18 and an inner frame 19. The outer frame 18 includes the lid 3 and part of the container portion 2, and the inner frame 19 forms part of the container 2. A container front wall 6 includes an inner front wall 6*a* and an outer front wall 6*b*. Similarly, two container side walls 8 include corresponding inner side walls 8*a* and outer side walls 8*b*. The inner front wall 6*a* extends from an upper end 16 of the outer front wall 6*b*. Similarly, the two inner side walls 8*a* extend from an upper end 17 of the corresponding outer side walls 8*b*. A container back wall 7 includes an inner rear wall 7*a* and an outer front wall 7*b*. The inner back wall 7*a* extends from an upper end of the outer rear wall 7*b*. A closed end 9 of the container 2 extends from a lower part of the container front, back and side walls 6, 7, 8.

When the lid 2 is in its closed position, a lid front wall 12 lies substantially adjacent to and overlaps the inner front wall 6*a* of the container front wall 6, and two lid side walls 14, lie adjacent to and overlap the corresponding inner side walls 8*a* of the container side walls 8. A lid back wall 13 lies substantially adjacent to and overlaps the inner back wall 7*a* of the container back wall 7. An end portion 15 of the lid 3 extends between upper ends of the lid front, back and side walls 12, 13, 14.

The inner frame 19 is formed by the inner front wall 6*a*, the inner side walls 8*a* and the inner back wall 7*a*. The inner frame 19 extends around and from an upper end of the outer front wall 6*b*, outer side walls 8*b* and outer back wall 7*b*. The inner side walls 8*a* extends from edges of the inner front wall 6*a*. The inner back wall 7*a* is formed from two back sections 54. The two back sections 54 each extend from a rear edge of the inner side walls 8*a*. Free ends 55 of the back sections 54 extend towards each other when the inner frame 19 is disposed in the outer frame 18. The two rear sections 54 forming the inner back wall 7*a* provide support for the inner side walls 8*a*. Therefore, the rigidity of the inner frame 19, in particular the inner side walls 8*a*, is increased. A cut-out is formed in the inner back wall 7*a* to aid retrieval of articles from the container portion when the lid 3 is in its open position.

Each container side wall 8 extends between the front wall 6 of the container 2 and the rear wall 7 of the container 2. Each container side wall 8 is arcuate and has a semi-circular profile. The front wall 6 of the container 2 meets each container side wall 8 at a tangent. Similarly, the rear wall 7 of the container 2 meets each container side wall 8 at a tangent. Similarly, each lid side wall 14 extends between the lid front wall 12 and the lid rear wall 13. Each lid side wall 14 is arcuate and has a semi-circular profile. The lid front wall 12 meets each lid side wall 14 at a tangent. Similarly, the lid rear wall 13 meets each lid side wall 14 at a tangent.

When the lid 2 is in its closed position, the arcuate inner faces of the lid side walls 14 lie adjacent to and overlap corresponding inner arcuate outer faces of the inner side walls 8*a* of the container 2.

A recess 24 is formed in each of the inner container side walls 8*a*. The recess 24 extends in the inner container side walls 8*a*. Each recess 24 has an arcuate lower edge 25, although alternatively shaped recesses may be used. Each recess 24 extends downwardly between an upper edge 20 of the inner front wall 6*a* and an upper edge of the inner back wall 7*a*. In an alternative arrangement a recess may be formed in one of the inner container side walls 8*a* only.

A flap 27 extends from an upper edge 20 of the inner front wall 6*a* of the container portion 2. Therefore, the flap 27 extends from the inner frame 19. The flap 27 is foldable about a fold line 28 which extends along the upper edge 20 of the inner front wall 6*a*. Although the flap 27 is notched or split by an indent 46 or slit in the present embodiment, it will be appreciated that in an alternative embodiment the flap 27 will not have an indent or slit.

One advantage of the or each recess being formed in the side wall of the container portion 2 is that the flap 27 can extend substantially along the width of the front wall 6 of the container portion 2. The flap 27 extends above the lower edge 25 of the recess 24. Therefore, when the lid is moved into its closed position the lid front wall 12 overlaps the flap 27 and the flap 27 abuts against the lid front wall 12.

The pack is operable in generally the same manner as described in the above embodiments. Therefore, when the lid 3 is moved into its closed position, flap 27 locates over the corresponding step edges to generate a audible click until the lid 3 is in its closed position.

It will be appreciated that the number of audible clicks produced may be changed by providing a different number of steps in the lid front wall 12. Moreover, it will also be appreciated that the number of audible noises produced may be changed by varying the number and length of the tab elements of the flap, together with the number and length of corresponding step edges.

When the lid 3 is moved into its open position, a user has access to smoking articles contained therein by means of the recesses formed in the inner frame 19.

Figure 11:
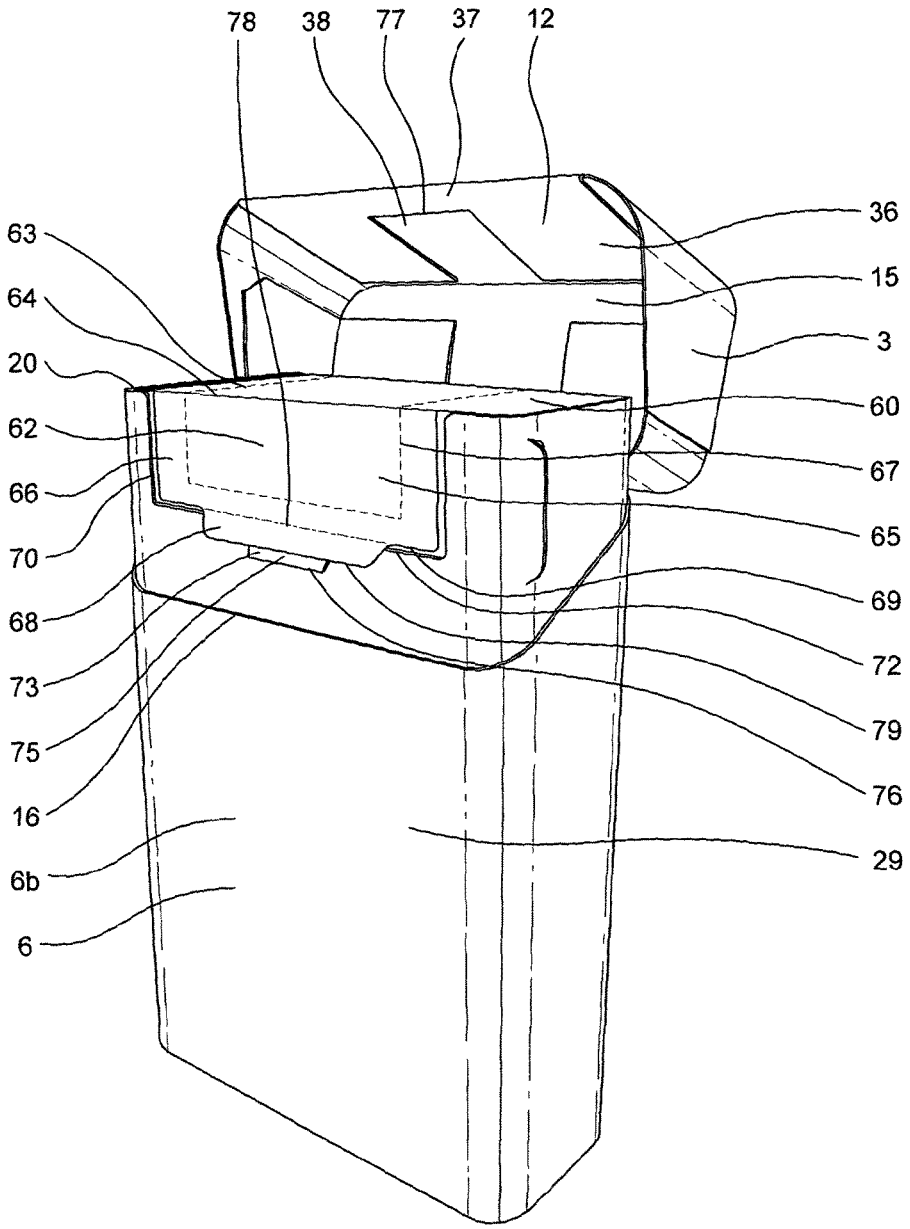
FIG. 11 is a perspective view of a package for smoking articles in accordance with a further embodiment of the present invention.
Figure 12:
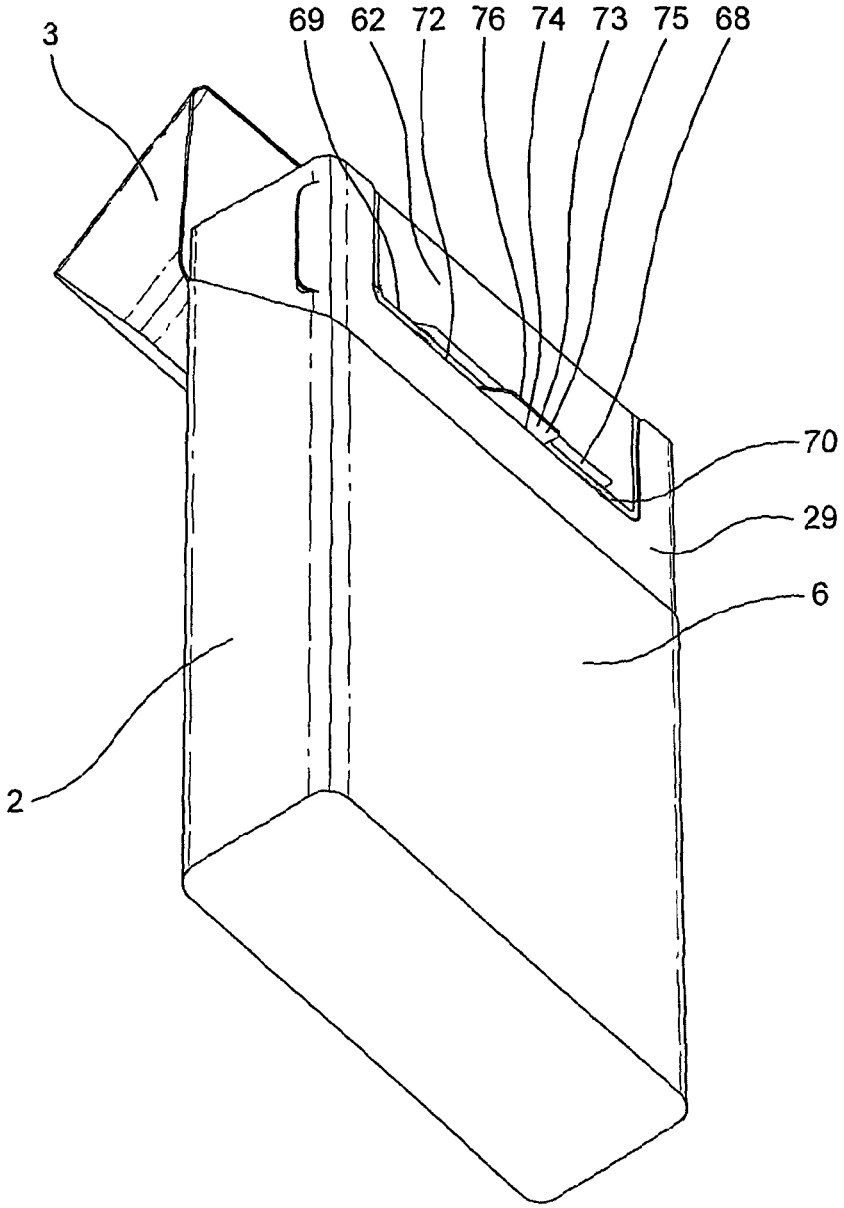
FIG. 12 is a perspective view from below of the package for smoking articles shown in FIG. 11.

Although in the above described embodiments the flap extends from the inner frame and the recess also extends from the inner frame, it will be understood that alternative arrangements are possible. For example, in an alternative arrangement the flap may be formed on the outer frame and the recess formed on the inner frame. Furthermore, the inner frame may be slidable relative to the outer frame. A further exemplary embodiment is shown in FIGS. 11 and 12. The arrangement of the package for smoking articles is generally the same as the arrangement described in the above exemplary embodiments, and so a further detailed description will be omitted herein. Furthermore, components and features corresponding to components and features described in the foregoing embodiments will retain the same reference numerals.

In the exemplary embodiment shown in FIGS. 11 and 12, the package for smoking articles further comprises a sealed enclosure 60 which encloses the smoking articles (not shown) formed by a barrier layer. An aperture 62 for allowing access to the smoking articles in the sealed enclosure 60 is indicated by dotted lines in FIG. 11. the aperture 62 is formed in the sealed enclosure 60 extending across a top face 63 of the enclosure 60 to a front edge 64 and partially down a front face of the enclosure 60 from the front edge 64. The barrier layer, which encloses the smoking articles, may be made for example of metallized plastics or of a plastics/metal foil laminate. A lamella is disposed over the aperture 62 in the form of a closure label 65, which has on its undersurface nearer to the barrier layer a permanently tacky adhesive. The permanently tacky adhesive is present where the closure label 65 extends at borders 66 beyond the openable edges 67 of the aperture 62.

A tab 68 extends from a lower edge 69 of the closure label so that it may be grasped by the user and used to pull the closure label to reveal the aperture 62. The tab 68 is free of the permanently tacky material. For first use, the openable edges 67 of the aperture 62 may have been defined by lines of weakening in the barrier material or by actual cuts to assist opening the aperture. The user is then free to remove cigarettes from the package through the aperture 62 and after having doing so may reseal the aperture simply by bringing down the tab so that the borders 66 re-adhere to the adjacent portions of the barrier layer material.

To ensure as far as possible efficient adhesion a second inner frame (not shown) is disposed within the sealed enclosure to offer a reaction surface underneath the barrier layer against the resealing pressure exerted by a user upon closure.

In this embodiment shown in FIGS. 11 and 12, the front wall 6 of the container portion 2 has a recess 70 formed therein. The recess 70 extends from the upper edge 20 of the front wall 6 and has a lower edge 72 that extends parallel to, but spaced from, the upper edge 20 of the front wall 6.

The lower edge 72 of the recess 70 is spaced from the upper end 16 of the container outer front wall **6*b* so that the lid front wall 12 overlaps the container front wall 6** along its entire width when the lid is in its closed position.

A flap 73, which acts as a locking element, extends from the lower edge 72 of the recess 70. The flap 73 is foldable about a fold line 74, configured as a perforation line in order to make it easier for the flap 73 to fold over, which extends along the lower edge 72 of the recess 70 and the flap 73 extends downwardly over the face 29 of the container front wall 6. The flap 73 is formed from a stiff resilient material, so that it is deformable, and it extends at an acute angle from the face 29 of the container front wall 6. A free end 75 of the flap 73 is spaced from the fold line 74 with a free edge 76.

A step 77, which acts as a locking part, is formed on an inner face 36 of the front wall 12 of the lid 3. The step 77 divides the inner face 36 of the lid front wall 12 into an upper level 37 and a lower level 38.

The flap 73 is configured to extend from the container front wall 6 such that it is aligned with and locates over the step 77 of the inner face 36 of the lid front wall 12 as the lid 3 is moved into its closed position. The flap 27, acting as a locking element, and the step 35, acting as a locking part, together form a locking mechanism to retain the lid 3 in its closed position.

The lower edge 69 of the closure label 65 extends proximate to the lower edge 72 of the recess 70. The tab 68 extends from the lower edge 69 of the closure label 65 that may be grasped by the user and used to pull the label to reveal the aperture 62 and allow access to the smoking articles in the sealed enclosure 60. The tab 68 is hinged about a hinge line 78. The tab 68 overlaps the lower edge 72 of the recess 70 and lies against the flap 73, with portions of the tab 68 extending either side of the flap 73.

A free end 79 of the tab 68 abuts the flap 73 but does not extend to the free end 75 of the flap 73, so that the free edge 76 of the flap 73 is able to locate over and engage with the step 77 on the lid 3 when the lid is moved into its closed position.

The tab 68 is urged away from the front wall 6 of the container portion 2 by the flap 73 so that a space is formed between the tab 68 and the front wall 6. Therefore, it is easy for a user to grasp the tab 68 and use it to pull the closure label 65 to open the package.

In an alternative arrangement, in which the flap 73 does not locate over and engage with a step on the lid, the free end 79 of the tab 68 extends over the flap 73. Therefore, the flap 73 is retracted behind the tab 68 and is not visible to a user. Furthermore, the length of the tab is extended and increases the ease with which a user is able to grasp the tab 68.

Although in the above embodiment the flap extends from the lower edge of the recess, it will be appreciated that in an alternative embodiment the container portion does not have a recess and the flap extends from the upper edge of the container front wall.

Although in the above described embodiments, the flap and step are formed in the front walls of the container portion and lid respectively, it will be appreciated that the flap may be formed in the lid and the step in the container portion. Furthermore, it will be appreciated that the flap and step may be formed in a side wall of the container portion and lid.

Although embodiments of the invention have been shown and described, it will be appreciated by those skilled in the art that variations may be made to the above exemplary embodiment that lie within the scope of the invention, as defined in the following claims.

The invention claimed is:

1. A package for smoking articles comprising a container portion having an inner frame and an outer frame, the outer frame including front and rear walls, and a lid hingedly connected to the rear wall about a hinge line, the lid including an end portion , a first lid wall that overlaps a first container wall of the inner frame and second lid walls that overlap a pair of second container walls of the inner frame when the lid is closed, the first container wall having a single locking element comprising a resiliently deformable flap extending from an upper edge of the first container wall about a fold line extending parallel to but spaced from the hinge line and in a direction between the second container walls, the flap resiliently deforming to locate over a corresponding locking part on the first lid wall when the lid is closed, said corresponding locking part comprising a step formed on an inner face of the first lid wall, said step comprising first and second step edges parallel but spaced from each other with said first step edge being closer to a lower end of the first lid wall than the second step edge so that, when the lid is closed, the flap initially locates over said first step edge and, as the lid is further moved into its closed position, the flap locates over said second step edge, and a recess formed in the inner frame extending from an upper edge of the inner frame into the first container wall and one of said second container walls, the locking element abutting against the lid front wall, wherein a lower edge of the recess is spaced further from the upper edge of the first container wall than the locking element, the recess having a first side edge in the first container wall and a second edge in one of said second container walls.

2. The package according to claim 1, wherein the inner frame upstands from an upper end of the outer frame.

3. The package according to claim 2, wherein the lower edge of the recess is spaced from the upper end of the outer frame.

* * * * *